US005270783A

United States Patent [19]

Bisaiji et al.

[11] Patent Number: 5,270,783

[45] Date of Patent: Dec. 14, 1993

[54] IMAGE FORMING EQUIPMENT HAVING IMPROVED TONER SENSING

[75] Inventors: Takashi Bisaiji; Kouji Hayashi, both of Yokohama; Noboru Sawayama, Tokyo; Takeyoshi Sekine, Tokyo; Takayuki Maruta, Tokyo; Norimitu Kikuchi, Yokohama; Tetsuro Miura, Tokyo; Kazunori Bannai, Tokyo; Kazunari Yamada, Tokyo; Nobuhiro Nakayama, Susono; Nobuyuki Koinuma, Yokohama, all of Japan

[73] Assignee: Ricoh Company, Ltd., Tokyo, Japan

[21] Appl. No.: 922,389

[22] Filed: Jul. 31, 1992

[30] Foreign Application Priority Data

| | | | |
|---|---|---|---|
| Jul. 31, 1991 | [JP] | Japan | 3-214565 |
| Oct. 22, 1991 | [JP] | Japan | 3-302558 |
| May 27, 1992 | [JP] | Japan | 4-160328 |

[51] Int. Cl.[5] ..... G03G 21/00

[52] U.S. Cl. ..... 355/246; 355/208; 355/245

[58] Field of Search ..... 355/245, 246, 251, 253, 355/261, 265, 326, 327, 203, 204, 208, 210

[56] References Cited

U.S. PATENT DOCUMENTS

| | | | |
|---|---|---|---|
| 4,620,783 | 11/1986 | Tanaka et al. | 355/245 X |
| 4,657,374 | 4/1987 | Kurmoto et al. | 355/251 |
| 4,910,557 | 3/1990 | Imai | 355/246 |
| 4,935,784 | 6/1990 | Shigehiro et al. | 355/253 |
| 5,047,804 | 9/1991 | Komura | 355/246 |
| 5,078,086 | 1/1992 | Kopko et al. | 355/251 X |
| 5,122,835 | 6/1992 | Rushing et al. | 355/208 |
| 5,132,733 | 7/1992 | Koizumi et al. | 355/245 |

*Primary Examiner*—A. T. Grimely
*Assistant Examiner*—Sandra L. Brasé
*Attorney, Agent, or Firm*—Oblon, Spivak, McClelland, Maier & Neustadt

[57] ABSTRACT

Image forming equipment having an image carrier and a developer carrier located face-to-face and forming an AC-superposed DC electric field between them to develop a latent image electrostatically formed on the image carrier. Sensors responsive to image forming conditions are provided and protected from noise ascribable to an AC component included in the electric field in the event when the sensors operate.

9 Claims, 15 Drawing Sheets

IMAGE FORMING EQUIPMENT HAVING IMPROVED TONER SENSING

BACKGROUND OF THE INVENTION

The present invention relates to image forming equipment having an image carrier and a developer carrier arranged face-to-face and forming an AC-superposed DC electric field between them for developing a latent image electrostatically formed on the image carrier. Also, the present invention is concerned with image forming equipment having sensor means located to face the surface of an image carrier in a position downstream of a developing device for developing an electrostatic latent image formed on the image carrier with respect to an intended direction of movement of the surface of the image carrier. The sensor means is responsive to a potential of and a reflection from a portion of the surface of the image carrier which does not positively deposit a toner, so that image forming conditions may be controlled on the basis of the outputs of the sensor means.

An electrophotographic copier, facsimile transceiver, printer or similar image forming equipment are provided with some sensors to have the image forming conditions thereof adequately controlled. The sensors include a potential sensor and an optical sensor located to face the surface of an image carrier, e.g., a photoconductive element, and a toner concentration sensor and a piezoelectric sensor disposed in a developing device. The potential sensor senses the potential of a latent image electrostatically formed on the photoconductive element, allowing the amount of charge, the amount of light for exposure and other image forming conditions to be controlled in response to the output thereof. The optical sensor is responsive to the amount of toner deposited on a pattern formed on the photoconductive element, so that the bias for development may be controlled on the basis of the output thereof. The piezoelectric sensor is responsive to the amount of developer existing in a developing device to allow a developer to be supplied in a controlled amount to the developing device. Further, the toner concentration sensor determines the concentration of a toner in the developer, i.e., the mixture ratio of toner and carrier, allowing the amount of toner in the developer to be controlled. The sensors, however, cannot operate with sufficiently high accuracy and even produce erroneous outputs.

It is a common practice with the above-described type of image forming equipment to use an AC-superposed DC bias for the development of a latent image. The bias including an AC component allows the toner to behave actively to thereby promote easy development. This not only reduces the required relative speed of the image carrier, e.g., photoconductive drum and the image carrier, e.g., developing roller but also promotes uniform development by eliminating an excessive edge effect. However, the problem with the Ac-superposed DC bias is that the previously stated sensors, particularly piezoelectric sensor and toner concentration sensor associated with the developing device, are apt to pick up noise ascribable to the AC component and cause needless carrier and toner particles to deposit on the image photoconductive drum in the event of sensing operation. The needless carrier and toner particles are wasteful and, in addition, apt to damage the photoconductive drum. To eliminate this problem, the AC component may be interrupted at the time when the sensors operate, as proposed in Japanese Patent Laid-Open Publication No. 85557/1990 by way of example. Although this kind of implementation successfully prevents the sensors from picking up noise ascribable to the AC component, it cannot prevent the needless carrier and toner particles from depositing on the photoconductive drum.

SUMMARY OF THE INVENTION

It is therefore an object of the present invention to provide image forming equipment which allows various sensors responsive to image forming conditions to operate stably and accurately.

It is another object of the present invention to provide image forming equipment which prevents needless carrier and toner particles from depositing on an image carrier when sensors responsive to image forming conditions operate.

In accordance with the present invention, image forming equipment locating an image carrier and a developer carrier face-to-face for forming an AC-superposed DC electric field between them and developing an electrostatic latent image formed on the image carrier by the electric field comprises a sensor adjoining part of a developing device where a developer is stored for sensing the state of the developer, and isolating means for cutting off, before the sensor senses the state of the developer, electrical connection of a bias application member to which a bias is applied for forming the electric field and the developer stored in the developing device and adjoining the sensor via the developer existing in the developing device.

Also, in accordance with the present invention, in image forming equipment wherein a sensor is located at a position downstream of a developing unit for developing an electrostatic latent image formed on the surface of an image carrier with respect to an intended direction of movement of the surface and positioned to face the surface, the sensor sensing a potential of or a reflection from a portion of the surface of the image carrier which does not positively deposit a toner, a non-contact condition wherein a developer stored in the developing unit does not contact the surface of the image carrier is set up while the portion of the surface passes a predetermined developing region.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, an optical sensor and a potential sensor located to face a photoconductive drum or similar image carrier will be described first.

Figure 10:
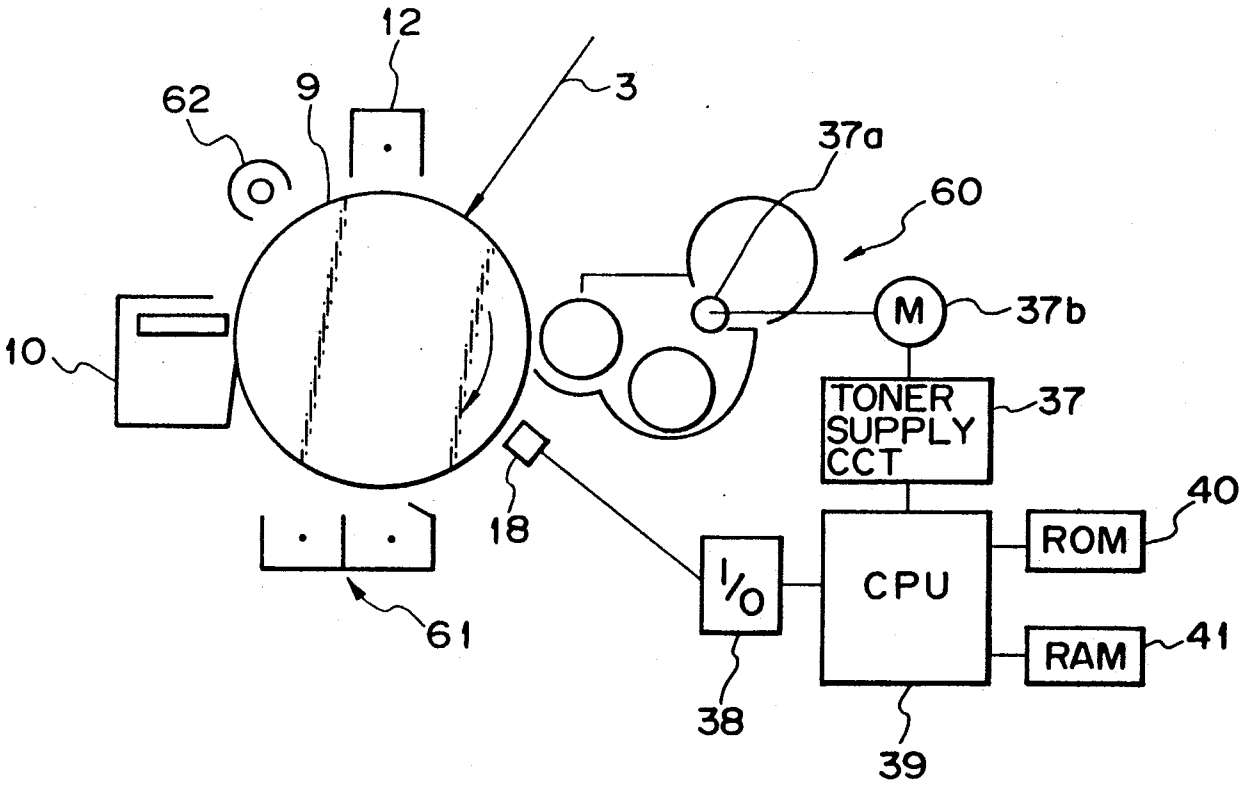
FIG. 10 shows a conventional electrophotographic copier using an optical sensor.

Referring to FIG. 10, a specific construction of an electrophotographic copier of the type controlling toner supply by use of an optical sensor is shown. As shown, an image carrier implemented as a photoconductive drum 9 is rotatable in a direction indicated by an arrow. Arranged around the drum 9 are a main charger 12 for uniformly charging the drum 9, a developing device 60 having a toner supply roller 37*a*, an image transfer and paper separation charger 61, a cleaning device 10, and a discharger 62. A reflection type optical sensor 18 is located between the developing device 60 and the charger 61 and faces the surface of the drum 9. The reference numeral 3 designates an imagewise light beam issuing from optics, not shown, for exposing the surface of the drum 9. The output of the sensor 18 is routed through an I/O (Input/Output) unit 38 to a CPU (Central Processing Unit) 39 which is provided with a ROM (Read Only Memory) 40 and a RAM (Random Access Memory) 41. In response, the CPU 39 sends a control signal to a motor driver 37 which drives the toner supply roller 37*a* via a motor 37*b*. Predetermined light from the optics, not shown, illuminates the surface of the drum 9 having been uniformly charged by the main charger 12. As a result, a a deposition potential portion for depositing a toner and having a relatively high potential and a reference potential portion having a relatively low potential are formed on the drum 9. A predetermined bias for development which prevents a toner from depositing on the reference potential portion is applied to the developing device 60. As the two potential portions pass the developing device 60, a toner is positively deposited only on the deposition potential portion. When the two potential portions one of which carries a toner thereon face the sensor 18, the ratio of the resulting outputs of the sensor 18 is calculated to determine a toner concentration. The toner supply roller 37*a* is driven on the basis of the toner concentration so as to supply a fresh toner from a toner hopper to a developing chamber which are included in the developing device 60.

Figure 11:
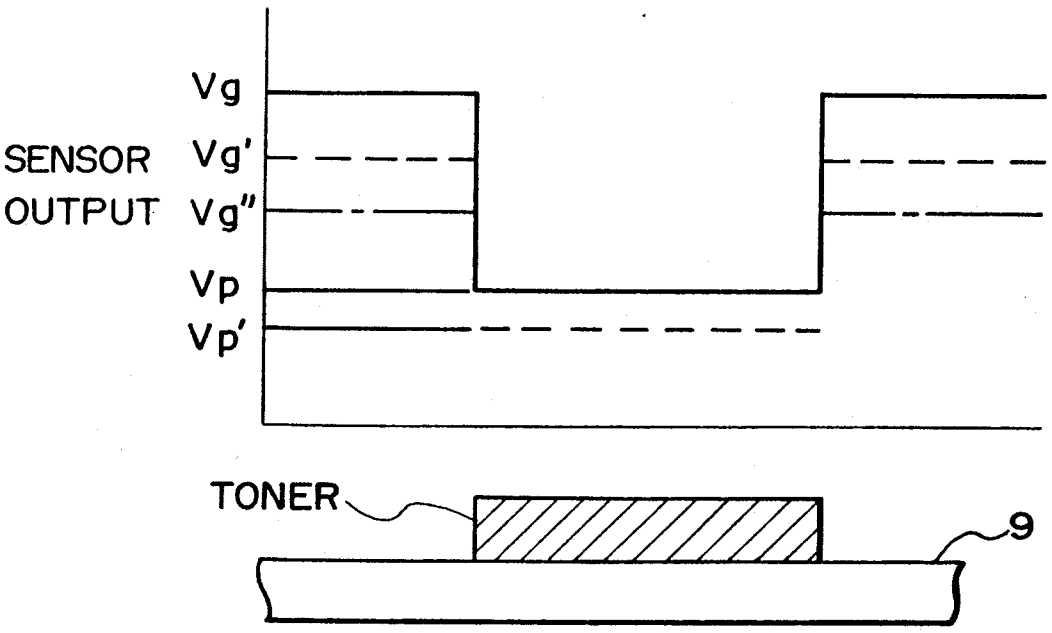
FIG. 11 is indicative of how the copier of FIG. 10 senses a reflection from a portion where a toner is deposited.

FIG. 11 shows a specific output of the optical sensor 18 representative of the above-stated deposition potential portion where the toner is deposited and reference potential portions preceding and following the former portion. Assume that the initial output of the sensor 18 is Vp for the deposition potential portion and Vg for the reference potential portion, and that Vp and Vg respectively change into Vp' and Vg' when the quantity of light to issue from the sensor 18 fall due to aging. Then, since the ratio x (%) of the fall of the quantity of light appear commonly in both of the outputs of the sensor 18 associated with the two potential portions, there holds a relation:

$$Vp'/Vg' = (Vp \cdot x/100)/(vg \cdot x/100) = Vp/Vg$$

It follows that the influence of the deterioration of the sensor 18 due to aging can be eliminated if the ratio of the sensor outputs associated with the two potential portions is used.

Figure 12:
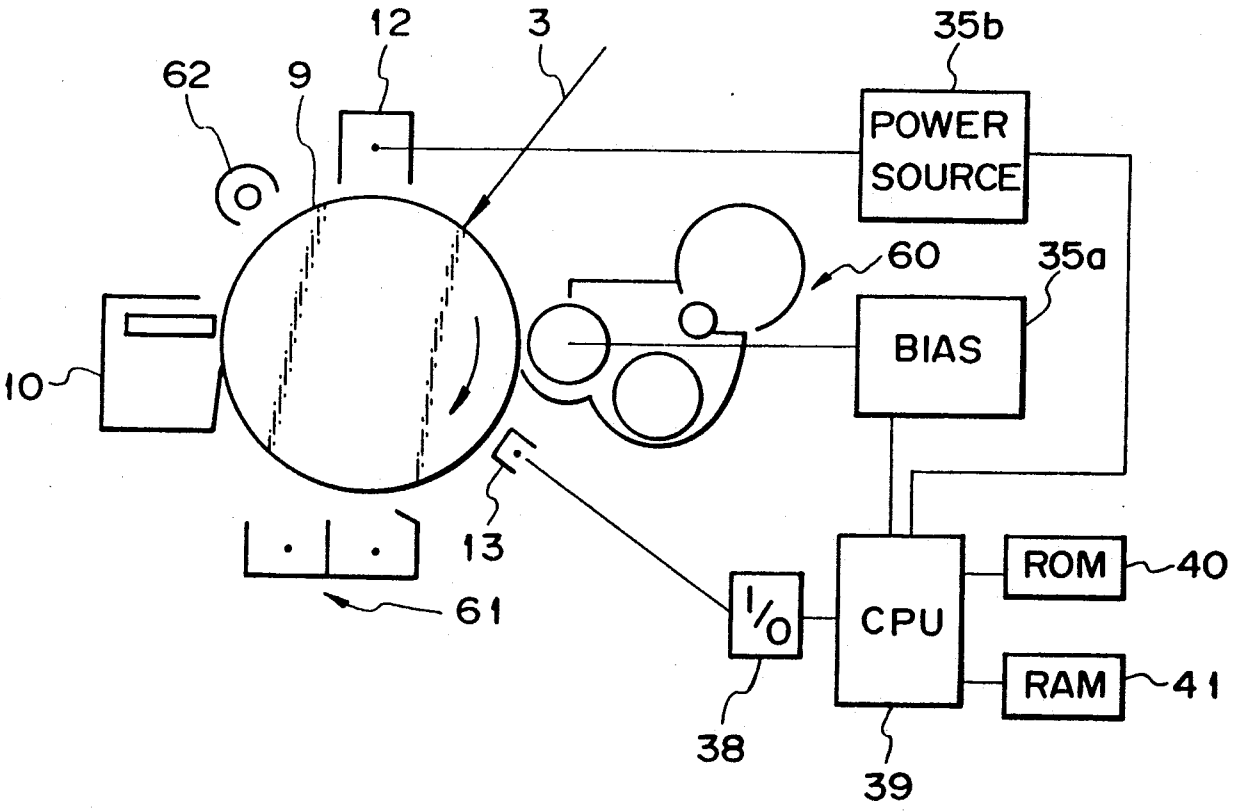
FIG. 12 shows a conventional electrophotographic copier using a potential sensor.

FIG. 12 shows another specific construction of an electrophotographic copier of the type controlling the output of the main charger 12 by using a potential sensor. As shown, the copier of FIG. 12 differs from the copier of FIG. 11 in that a potential sensor 13 is substituted for the optical sensor 18, and in that the output of the main charger 12 is controlled in place of the rotation of the toner supply roller 37*a*. To control the output of the main charger 12, the CPU 39 sends a control signal to a high tension power source 35*b* associated with the main charger 12. The output of the potential sensor 13 is also used to control the bias to be applied to the developing device 60, i.e., the CPU 39 sends a control signal to a bias power source 35*a* as well. Specifically, the potential sensor 13 senses the surface of the drum 9 having been uniformly charged by the main charger 12 or a portion of the charged surface of the drum 9 having been illuminated by predetermined light from the optics, not shown. Then, the output of the main charger 12 and the bias for development are controlled.

While the optical sensor 18 and the potential sensor 13 are usually located downstream of the position where the optics writes an image on the drum 9 and upstream of the developing device 60, they are sometimes located downstream of the device 60, as shown in FIGS. 10 and 12, for layout reasons. However, the sensor 18 or 13 located downstream of the developing device 60 brings about the following problem. When a reflection from the reference potential portion is to be sensed by the sensor 18 or when a potential pattern is to be sensed by the sensor 13, it is necessary that no toner be present on the drum 9. For example, in FIG. 10, assume that the toner is deposited on the reference potential portion of the drum 9. Then, only the output of the sensor 18 associated with the reference potential portion changes into Vg'' shown in FIG. 11. As a result, despite that the amount of toner deposited on the other or deposition potential portion is the same, the toner concentration calculated on the basis of the previously mentioned ratio will be lower than the actual concentration. On the other hand, in FIG. 12, the toner deposited on the potential pattern will apply offset to the potential of the drum 9 since the toner itself is charged, obstructing accurate potential sensing. Such a problem is usually ascribable to the condition of a developer, particularly the charge deposited on the toner, and often occurs when the amount of charge of the toner is small, although the mechanism depends on the case.

To increase the amount of charge of the toner, i.e., to prevent the toner from depositing on the above-mentioned portion of the drum 9, various toner compositions as well as implementations for agitating the developer sufficiently are under development. However, a satisfactory result has not been reported yet. Especially, in the case of color image forming equipment having a plurality of developing units each storing a particular developer, it is difficult to stabilize the toners of all the developers in the same manner against aging and varying environment. In addition, excessive agitation sometimes aggravates the deterioration of the developer.

Figure 1:
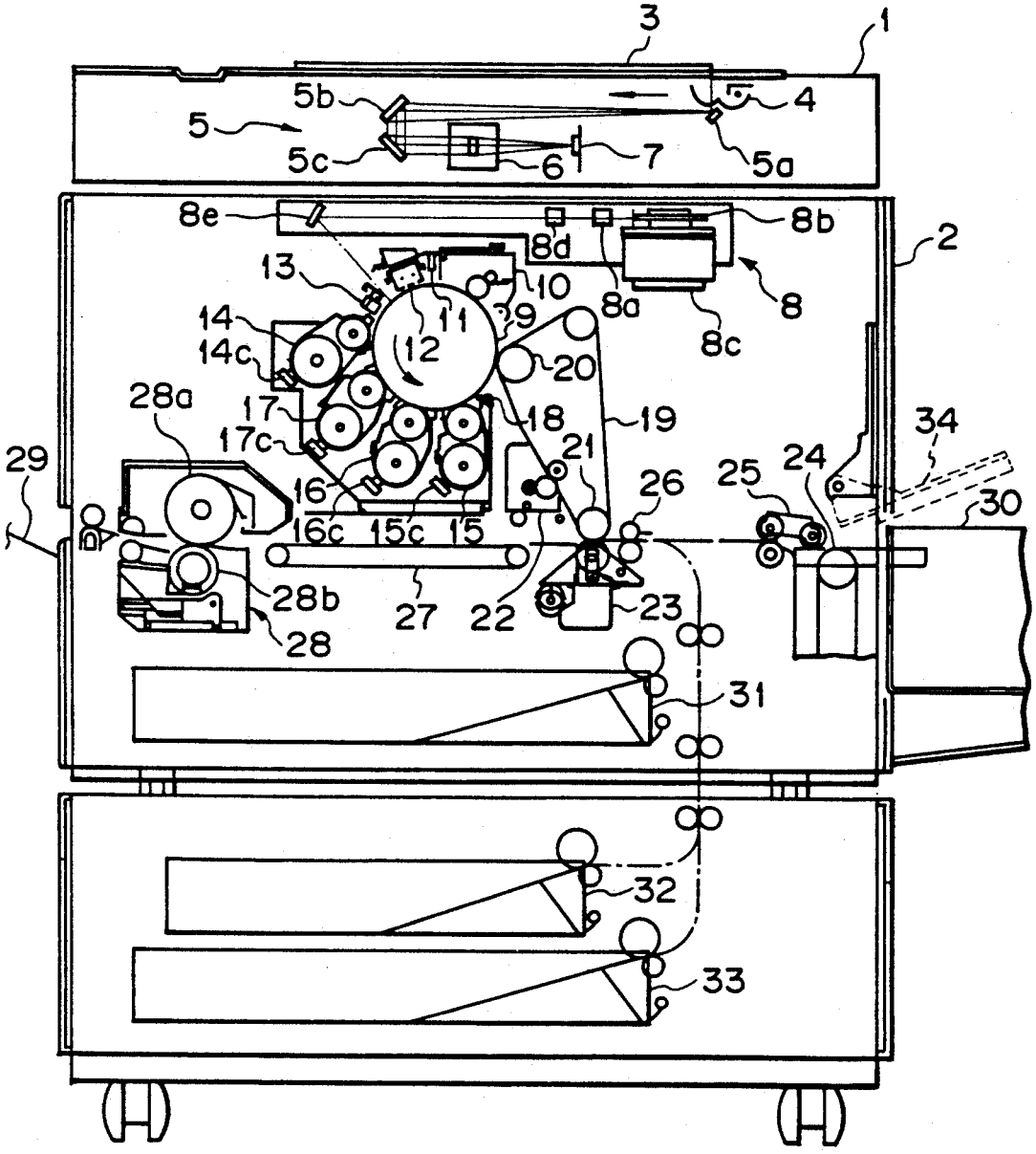
FIG. 1 is a section of a copier representative of image forming equipment embodying the present invention.
Figure 2:
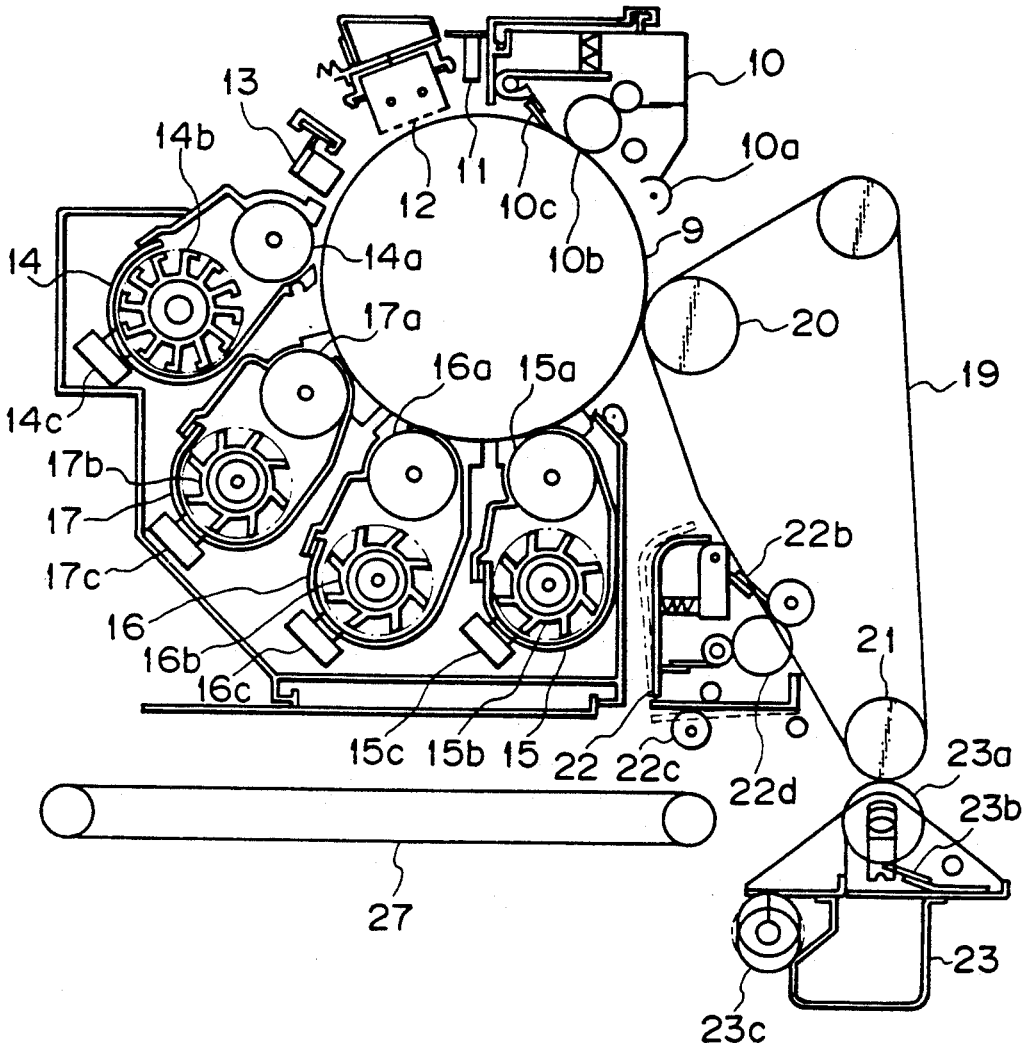
FIG. 2 is an enlarged section showing the arrangement of a photoconductive drum, an intermediate transfer belt an so forth included in the embodiment.

Referring to FIGS. 1 and 2, image forming equipment embodying the present invention and implemented as a color copier will be described. As shown, a color image reading device, or color scanner, 1 illuminates an image printed on a document 3 by a lamp 4 and focuses a reflection from the document 3 onto a color sensor 7 via mirrors 5 and a lens 6. The color sensor 7 reads the incident color document information on the basis of separated color components, e.g., blue (B), green (G) and red (R) components and transforms them to electric image signals. In the illustrative embodiment, the color sensor 7 is implemented by B, G and R color separating means and a CCD (Charge Coupled Device) image sensor or similar photoelectric converting means so as to read the three colors at the same time. An image processing section, not shown, produces black (Bk), cyan (C), magenta (M) and yellow (Y) color image data on the basis of the intensity levels of the B, G and R image signals generated by the color scanner 1. A color image recording device, or color printer, 2 which will be described produces a composite color image in response to the Bk, C, M and Y image data. To generate the Bk, C, M and Y image data, the color scanner 1 is operated such that the illumination and mirror optics thereof scans the document 3 from right to the left, as viewed in FIG. 1, in response to a scanner start signal synchronous with the operation of the color printer 2. Every time the color scanner 1 scans the document 3, image data of one color is generated. Specifically, the scanning operation is repeated four times in total to generate image data of four different colors one after another. The color printer 2 prints out the color image data one after another while superposing the images to complete a full-color image.

The color printer 2 has an optical writing unit 8 for transforming the color image data from the color scanner 1 to an optical signal and thereby writing an image corresponding to the document image on a photoconductive drum 9. As a result, a latent image is electrostatically formed on the drum 9. The writing unit 8 is made up of a laser **8*a*, a laser driver, not shown, a polygonal mirror 8*b*, a motor 8*c* for rotating the mirror 8*b*, an f-theta lens 8*d*, a mirror 8*e* and so forth. The drum 9 is rotatable counterclockwise, as indicated by an arrow in the figures. Arranged around the drum 9 are a cleaning unit 10 including a precleaning charger, not shown, a discharge lamp 11, a main charger 12, a potential sensor 13, a Bk developing unit 14, a C developing unit 15, an M developing unit 16, a Y developing unit 17, an optical sensor 18 responsive to a development density pattern, an intermediate transfer belt 19 and so forth. As shown in FIG. 2, the developing units 14–17 have respectively developing sleeves 14*a*–17*a*, paddles 14*b*–17*b*, and toner concentration sensors 14*c*–17*c*. The developing sleeves 14*a*–17*a* are each rotatable with the tip of a developer deposited thereon contacting the surface of the drum 9 for developing a latent image. The paddles 14*b*0 17*b*** scoop their associated developers while agitating them.

In a standby state, in all the four developers 14–17, the developers deposited on the developing sleeves **14*a*–17*a*** are held in a condition unable to develop. The copying operation will be outlined hereinafter on the assumption that Bk, C, M and Y images are developed in this order by way of example.

At the beginning of a copying operation, the color scanner 1 starts reading Bk image data at a predetermined time. The optical writing using a laser beam and the formation of a latent image begin in response to the image data. Let the latent images formed by the Bk data, C data, M data and Y data be referred to as a Bk latent image, C latent image, M latent image, and Y latent image, respectively. Before the leading edge of the Bk latent image arrives at the developing region of the Bk developing unit 14, the developing sleeve **14*a* begins rotating to prepare the developer deposited thereon for development. As a result, the Bk latent image is developed by the Bk toner. As soon as the trailing edge of the Bk latent image moves away from the Bk developing region, the developer on the Bk developing sleeve 14*a* is made unable to develop. This is completed at least before the leading edge of the C latent image associated with the C image data arrives at the Bk developing region. To make the developer unable to develop, the rotation of the developing sleeve 14*a* may be reversed by way of example. The Bk toner image formed on the drum 9 by the above procedure is transferred to the intermediate transfer belt 19. Let the transfer of a toner image from the drum 9 to the belt 19 be called belt transfer hereinafter. The belt transfer is effected by applying a predetermined bias voltage to a transfer bias roller 20 while the drum 9 and belt 19 are in contact. The Bk, C, M and Y toners sequentially formed on the drum 9 are transferred to the belt 19 one after another to form a four-color toner image, and then the four-color image is transferred to a paper sheet at a time. An intermediate transfer belt unit including the belt 19** will be described in detail later.

After the Bk step, the drum 9 starts on a C step. Specifically, the color scanner 1 starts reading C image data at a predetermined time. A C latent image is formed by a laser beam in response to the C image data. The developing unit 15 has the developing sleeve **15*a* thereof rotated after the trailing edge of the Bk latent image has moved away from the developing region thereof and before the leading edge of the C latent image arrives. As a result, a developer deposited on the sleeve 15*a* is rendered operative to thereby develop the C latent image by a C toner. As soon as the trailing edge of the C latent image moves away from the developing region, the developer on the sleeve 15*a*** is disenabled. This is also completed before the leading edge of the following M latent image arrives. Such a procedure is also true for the M and Y steps to follow.

The intermediate transfer belt unit is constructed as follows.

The intermediate transfer belt 19 is passed over a drive roller 21 and driven rollers as well as over the previously mentioned bias roller 20. The belt 19 is driven by a motor, not shown. A belt cleaning unit 22 has a brush roller **22*a*, a rubber blade 22*b*, and a mechanism 22*c* for moving the unit 22** toward and away from the belt 19. After the Bk image, or first image, has been transferred to the belt 19, the belt cleaning unit 22 is spaced apart from the belt 19 by the mechanism 22c while the belt transfer of the second, third and fourth colos are under way. A paper transfer unit 23 has a bias roller 23a, roller cleaning blade 23b, and a mechanism 23c for moving the unit 23 toward and away from the belt 19. The bias roller 23a is usually spaced apart from the surface of the belt 19, but it is pressed against the belt 19 by the mechanism when a four-color image is to be transferred from the belt 19 to a paper sheet. For the transfer of the four-color image to a paper sheet, a predetermined bias voltage is applied to the bias roller 23a.

As shown in FIG. 1, a paper sheet 24 is fed by a feed roller 25 and a register roller 26 at the time when the leading edge of the four-color image on the intermediate transfer belt 19 arrives at a paper transfer position. The paper sheet 24 to which the image has been transferred from the belt 19 is transported by a paper transport unit 27 to a fixing device 28. In the fixing device 28, a fixing roller 28a controlled to a predetermined temperature coacts with a pressure roller 28b to fix the toner image on the paper sheet 24. The paper sheet 24 coming out of the fixing device 28 is driven out to a copy tray 29 as a full-color copy. After the belt transfer, the drum 9 has the surface thereof cleaned by the cleaning unit 10 having a precleaning charger 10a, a brush roller 10b, and a rubber blade 10c. Thereafter, the drum 9 is uniformly discharged by the discharge lamp 11. On the other hand, the cleaning unit 22 is again urged against the belt 19 by the mechanism 22c to clean the surface of the belt 19.

In a repeat copy mode, the operation of the color scanner 1 and the image forming procedure for the second Bk (first color) image begin after the first Y (fourth color) image has been formed. Regarding the intermediate transfer belt 19, after the first four-color image has been transferred to a paper sheet, the second Bk toner image is transferred from the drum 9 to the area of the belt 19 having been cleaned by the cleaning unit 22. This is followed by the same procedure as with the first four-color image. Paper cassettes 30, 31, 32 and 33 are each loaded with paper sheets of particular size, and one of them is selected on an operation panel, not shown. The paper sheets stored in the designated paper cassette are fed one after another toward the register roller 26. The reference numeral 34 designates an extra tray available for inserting OHP sheets or thick sheets by hand.

While the above description has concentrated on a four-color or full-color copy mode, the same operation will be repeated even in a three-color or two-color copy mode a number of times matching the designated colors and designated number of copies. Further, in a single color or monocolor mode, only the developing unit associated with the color of interest is rendered operative until a desired number of copies have been produced. At this instant, the belt 19 is continuously driven at a constant speed in the forward direction in contact with the drum 9 while the belt cleaner 22 is also held in contact with the belt 19.

Figure 3:
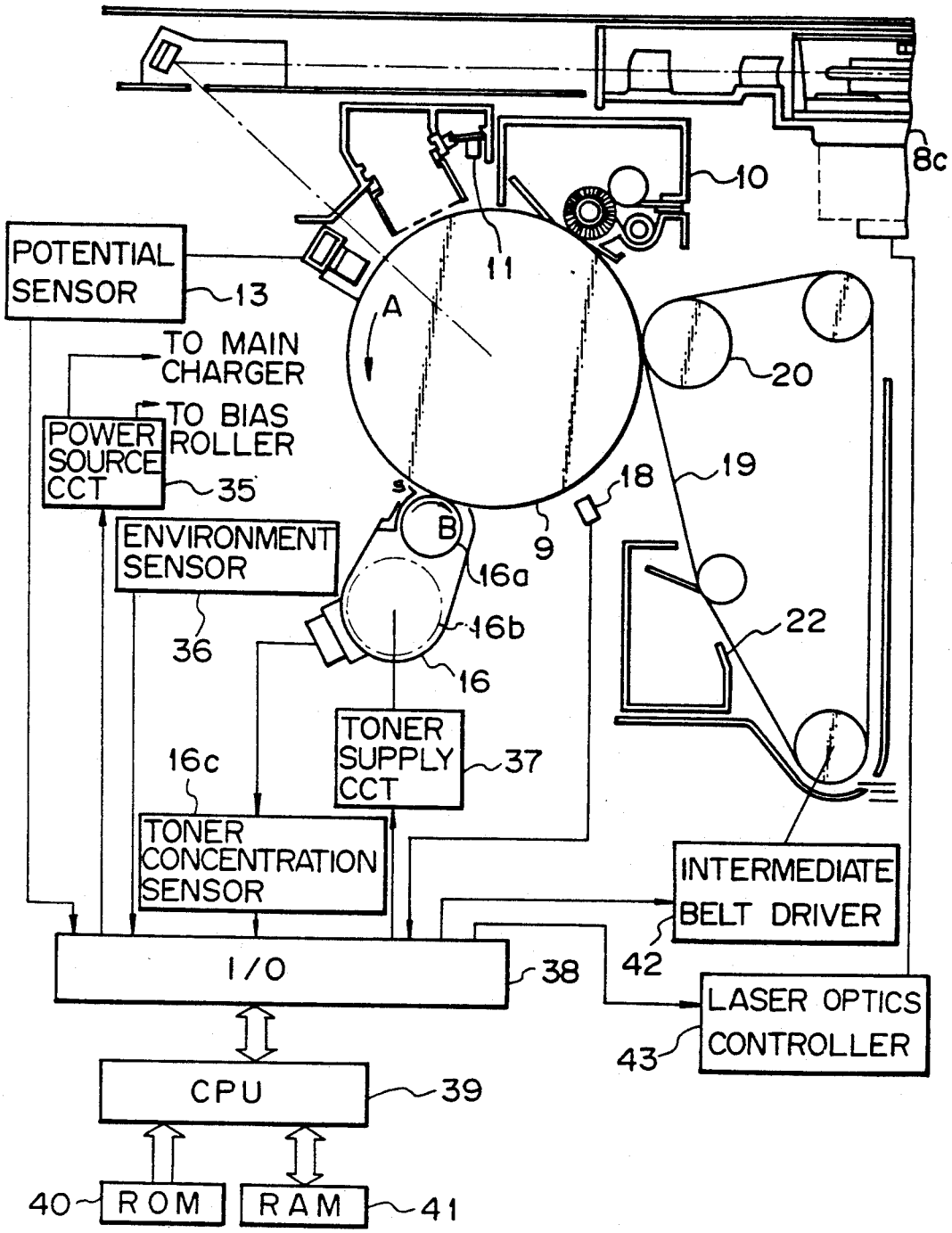
FIG. 3 shows a control system included in the embodiment.

Referring to FIG. 3, a control system incorporated in the copier includes a main controller (CPU) 39 which is provided with a ROM 40 and a RAM 41. A laser optics controller 43, a power source circuit 35, the optical sensor 18, the toner concentration sensor 16c, an environment sensor 36, the drum potential sensor 13, a toner supply circuit 37 and an intermediate belt driver 42 are connected to the main controller 39 via an I/O interface 38. While FIG. 3 shows only the M developing unit 16, the other developing units 14, 15 and 17 also have their toner concentration sensors 14c, 15c and 17c, toner supply circuits 37 and power source circuits 35 connected to the main controller 39 via the I/O interface 38. The laser optics controller 43 adjusts the output of the laser optics 8. The power source circuit 35 applies a predetermined discharge voltage to the main charger 12, applies a predetermined AC-superposed DC bias for development to the developing unit 16, and applies a predetermined transfer voltage to each of the bias rollers 20 and 23a.

The optical sensor 18 is implemented as a photoelectric sensor consisting of a light emitting diode or similar light emitting means and a photosensor or similar light-sensitive means which are located to face part of the drum 9 undergone development. The sensor 18 senses, color by color, the amount of toner deposition on a reference pattern latent image formed on the drum 9 and the amount of toner deposition on the background. In addition, the sensor 18 senses a so-called residual potential remaining on the drum 9 after the discharge. If desired, the reflection type optical sensor 18 may be replaced with a transmission type sensor if the part of the drum 9 for forming a reference pattern is made up of a transparent electrode and a photoconductive element which is transparent for predetermined light. The toner concentration sensor 16c senses a toner concentration in terms of the permeability of the developer existing in the developing device 16. When the toner concentration becomes lower than predetermined one, i.e., when the toner is short, the CPU 39 sends a toner supply signal complementary to the shortage to the toner supply circuit 37 in response to the output of the sensor 16c. Further, the potential sensor 13 is responsive to the surface potential of the drum 9 and allows the charge potential and the potential after illumination to be adjusted to their predetermined values.

The illustrative embodiment prevents noise from being introduced in the outputs of the sensors, as follows.

The anti-noise implementation for the toner concentration sensors 14c–17c will be described first. Generally, a carrier included in a two-component type developer is constituted by oxidized simple iron, carbonated silicon, or Teflon-coated substance. The carrier, therefore, acts as a resistor when combined with a toner. It follows that when such a two-component type developer extends from the developing sleeve to which the AC bias is applied to the toner concentration sensor, the AC bias interferes with the sensor via the developer. This is also true with a one-component type developer which is void of the carrier.

Figure 4A:
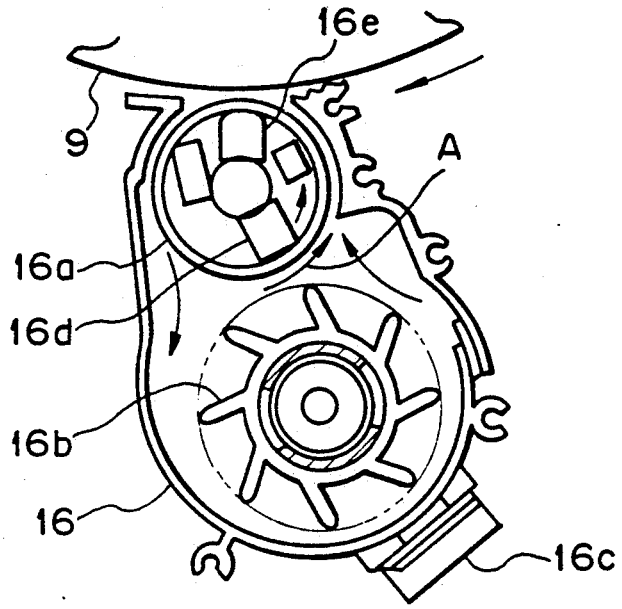
FIGS. 4A and 4B are fragmentary views of the embodiment, showing a specific implementation for removing a developer from a developing region.
Figure 4B:
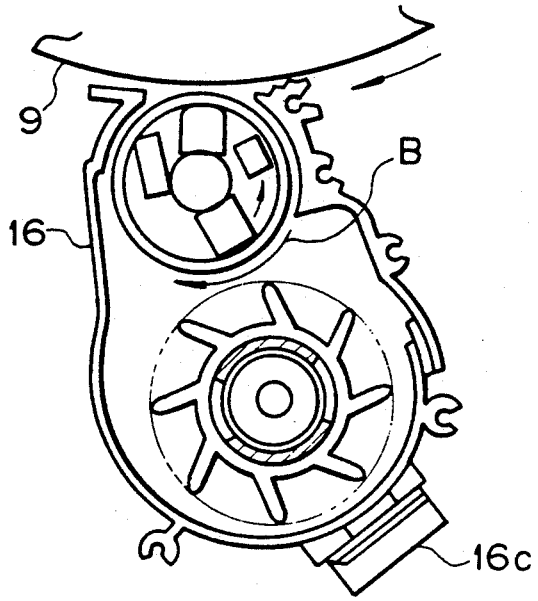

As shown in FIGS. 4A and 4B, the M developing unit 16, for example, has a scoop magnet 16d and a main pole magnet 16e located at predetermined positions inside the developing sleeve 16a. A developer fall position is defined in the M developing unit 16 where the magnetism is substantially zero to let the developer fall from the surface of the sleeve 16a. Reversible drive means, not shown, drives the sleeve 16a. During development, the sleeve 16a is rotated in a predetermined direction indicated by an arrow A (forward rotation) in FIG. 4A. On the completion of the development, the sleeve 16a is reversed as indicated by an arrow B (reverse rotation) so as to remove the developer from the part of the surface of the sleeve 16a facing the surface of the drum 9. The reverse rotation of the sleeve 16a may be effected only for a predetermined period of time in the event of transition from the operative state to the inoperative state or continuously throughout the non-development period. In any case, the developer does not continuously exist between the developer staying at the bottom of the developing unit 16, to which the sensor 16c is affixed, and the sleeve 16a. In this condition, the sleeve 16a and the developer staying at the bottom of the developing unit 16 are electrically isolated from each other. Therefore, when the sensor 16c senses a toner concentration in the above condition, noise ascribable to the AC component of the AC-superposed bias for development is eliminated despite the continuous application of the bias. This was proved by a series of experiments.

In the light of the above, the embodiment causes the toner concentration sensor to sense a toner concentration after the developing sleeve has been reversed to remove the developer from the region where the sleeve faces the drum 9. Preferably, the sensing operation should be performed during the course of image formation, i.e., while an image is printed out. For example, since the embodiment necessarily switches over the developing unit during the image forming process, as previously stated, the period of time for the switchover may be used to effect the sensing operation. However, a period of time long enough for the sensor to sense a toner concentration is not always guaranteed due to the switchover period of the developing unit which is decreasing to meet the demand for a higher process speed. The sensing time should suffice at least the response of the sensing circuit including the sensor and the processing and transfer of the sensor output. In such a case, the sensing operation may be performed during a period other than the image forming period, i.e., at the start-up of the copier, in a standby state, or before or after the image forming process. Since the toner concentration is sensed in each of the developing units, the unable state of the developer may be set up only in one developing unit which is to sense a toner concentration.

Figure 8A:
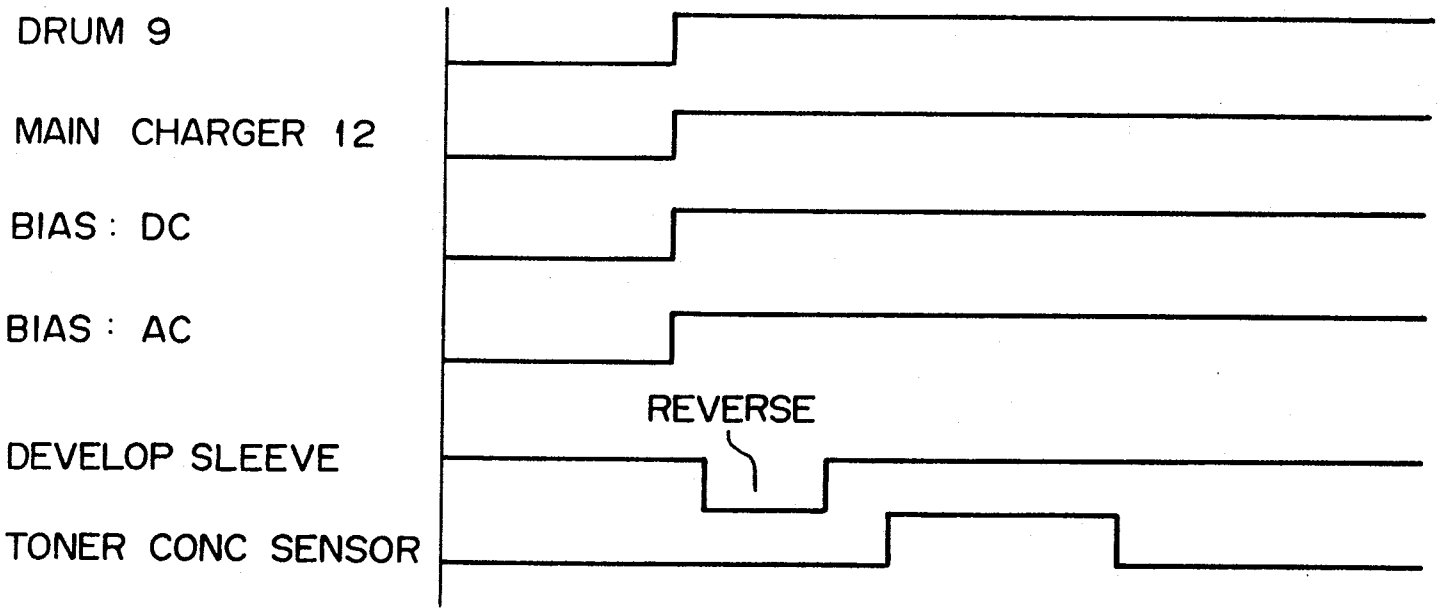
FIG. 8A is a timing chart representative of a specific procedure for a toner concentration sensor shown in FIG. 1 to sense a toner concentration.

FIG. 8A shows a specific procedure in which the toner concentration sensor senses a toner concentration in the associated developing unit before the image forming process. As shown, on the start of rotation of the drum 9, the charger 12 is driven and the application of the bias (AC and DC) to the developing sleeve, e.g., 16a begins. Slightly later than this, the developing sleeve 16a having been in a halt is rotated in the reverse direction for a predetermined period of time to remove the developer from the previously stated particular region. As a result, the sleeve 16a and the developer existing at the bottom of the developing unit 16 are electrically isolated from each other. Then, the toner concentration sensor 16c mounted on the bottom of the developing unit 16 is caused to sense a toner concentration in the unit 16. It is to be noted that any other conventional implementation for electrically insulating the sleeve 16a and the developer adjoining the sensor 16c may be used in place of the above-stated one, as follows.

Figure 5A:
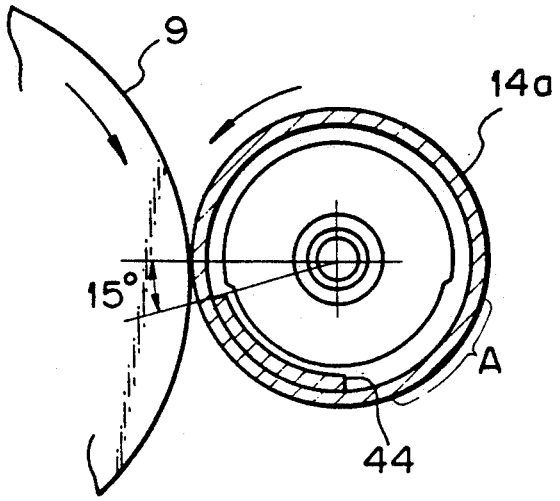
FIGS. 5A and 5B are views showing another specific implementation for removing a developer from a developing region.
Figure 5B:
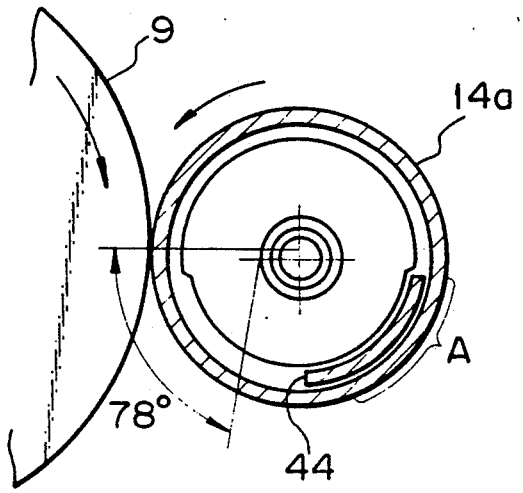

As shown in FIGS. 5A and 5B, the Bk developing unit 14, for example, has a magnetic shield plate 44 in the developing sleeve 14a thereof. The shield plate 44 is implemented by, for example, a gulvanized steel plate 44 and movable between a position (FIG. 5A) corresponding to a developer fall position and a position (FIG. 5B) corresponding to a developer scoop position (A, FIG. 5A). During development, the shield plate 44 is moved to the position of FIG. 5A away from the developer scoop position A, so that the developer may be deposited on the sleeve 14a by the force of the magnet acting on the position A. While development is not under way, the shield plate 44 is held in the position corresponding to the developer scoop position A. In this condition, the force of the magnet does not act on the position A of the sleeve 14a, i.e., the magnetism in the position A is substantially zero. Then, as the sleeve 14a is rotated, the developer deposited thereon is collected in the developing unit 14. Consequently, the amount of developer on the sleeve 14a decreases to zero or to an amount small enough to remain clear of the drum 9. This is also successful in electrically isolating the sleeve 14a and the developer staying at the bottom of the sleeve 14a.

In the specific implementations described above, the developer does not exist on the developing sleeve at the time when the toner concentration sensor operates. However, it is not necessary that the developer on the sleeve be fully removed, since the gist is to electrically isolate the developing sleeve and the developer existing at the bottom of the developing unit and adjoining the sensor. For example, an insulating plate may be movably disposed in the developing unit and inserted into the developer existing between the developer on the sleeve and the developer adjoining the sensor. Then, the developer on the sleeve and the developer adjoining the sensor will be electrically isolated even when the developer is carried on the sleeve in the same manner as during development.

The fact that the developer is absent on the developing sleeve during the course of the sensing operation is desirable since the developer in the developing unit does not contact the surface of the drum 9, i.e., since needless toner and carrier particles are prevented from depositing on the drum 9. To eliminate the noise ascribable to the AC component of the bias more positively, at least the application of the AC component to the sleeve may be interrupted in the event of the toner concentration sensing operation.

Hereinafter will be described how to prevent noise from being picked up by the potential sensor 13 and optical sensor 18 facing the drum 9 and how to prevent needless toner particles and carrier particles from depositing on the drum 1.

Assume that the potential sensor 13 or the optical sensor 18 performs a sensing operation while an AC-superposed DC bias for development is applied to the developing sleeve of the associated developing unit. Then, noise will be introduced in the output of the sensor 13 or 18 due to the AC component of the bias. This is presumably because the AC component applied to the developing sleeve causes noise to occur in the sensor by induction. Regarding the operation of the potential sensor 13, it is not necessary for the developing unit to be positioned such that the developer contacts the surface of the drum 9. Rather, should the developer contact the drum 9, needless toner and carrier particles would deposit on the drum 9. Especially, such needless particles are apt to deposit on the drum 9 when a reference latent image having a predetermined potential is formed on the drum 9 for sensing the surface potential of the drum 9. Also, when the optical sensor 18 senses a development density pattern, the density pattern has already moved away from the developing unit and, therefore, the developing unit does not have to be so positioned as to maintain the developer in contact with the drum 9. Rather, should the developer contact the drum 9, toner and carrier particles would be undesirably deposited on the drum 9.

In the light of the above, when the potential sensor 13 or the optical sensor 18 is to operate, the embodiment interrupts at least the application of the AC component of the bias for development to the developing sleeve and, at the same time, maintains the developer of the developing unit clear of the surface of the drum 9. Not only the AC component but also the DC component of the bias may be interrupted, if desired. It is to be noted that the interruption of the bias may be implemented as either of a grounded state and a floating state. The operation of the sensor 13 or 18, like the operation of the toner concentration sensor stated earlier, should preferably occur while an image forming process or printing process is under way. This, however, depends on the situation, as previously mentioned in relation to the toner concentration sensor.

Figure 8B:
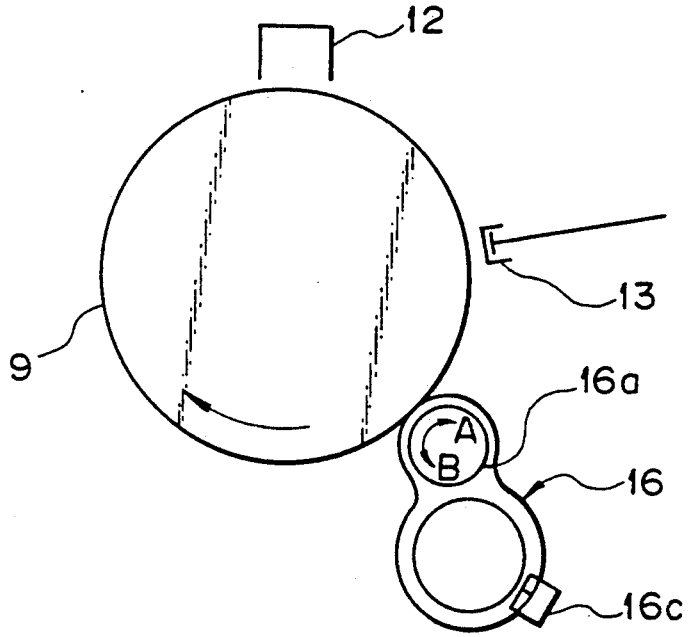
FIG. 8B shows a positional relation of a main charger, a potential sensor, and a developing unit arranged around the photoconductive element.
Figure 8C:
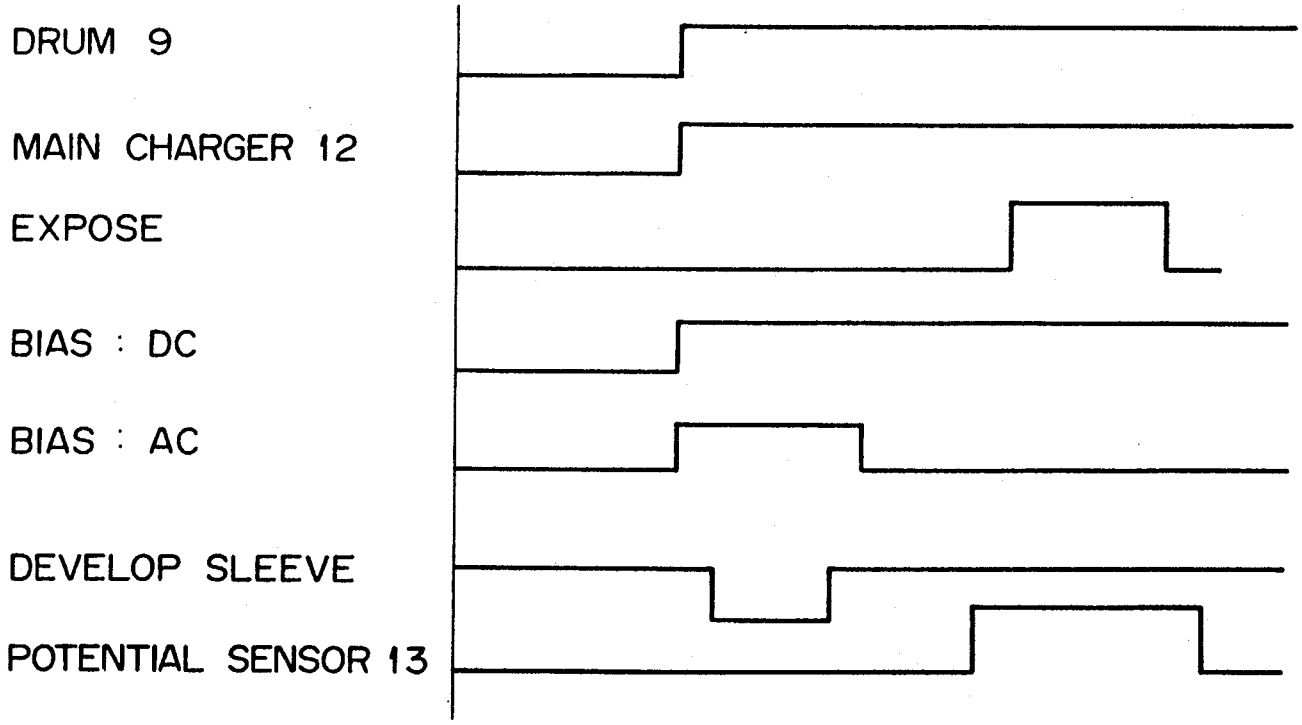
FIG. 8C is a timing chart demonstrating a specific procedure for a potential sensor shown in FIG. 1 to sense a potential.

FIG. 8C shows a specific procedure wherein the potential sensor 13 sense the potential of a potential portion formed on the drum 9 and where the toner is not deposited, before the image forming process. FIG. 8B shows a positional relation of the main charger 12, potential sensor 13 and developing unit, e.g., 16 arranged around the drum 9 for reference. As shown in FIG. 8C, on the start of rotation of the drum 9, the bias for development (DC and AC) begins to be applied to the developing sleeve, e.g., 16*a* of the M developing unit 16 while the main charger 12 is energized. Slightly later than this, the developing sleeve 16*a* is rotated in the reverse direction for a predetermined period of time to thereby prevent the sleeve 16*a* and the drum 9 from being electrically connected by the developer. Subsequently, after at least the application of the AC component of the bias has been interrupted, an eraser, for example, illuminates the drum 9 to form a region where the toner does not deposit. The potential sensor 13 senses the potential of the above-mentioned region of the drum 9.

Figure 6A:
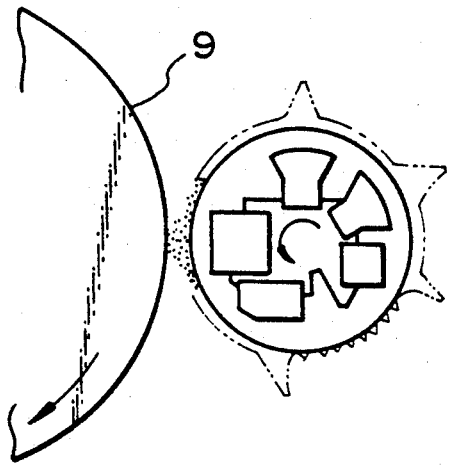
FIGS. 6A and 6B are views showing how the embodiment moves a developer away from a photoconductive element.
Figure 6B:
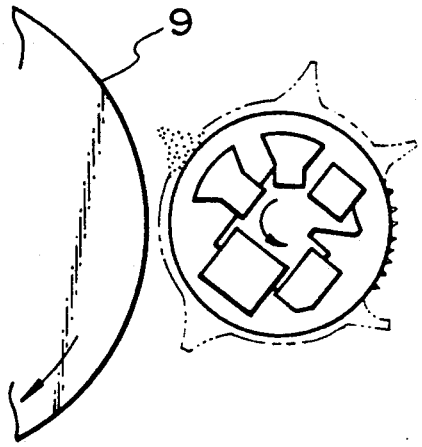

Other implementations available with the embodiment for preventing the developer of the developing unit from contacting the drum 9 are as follows. Specifically, as shown in FIGS. 6A and 6B, magnets may be disposed in the developing sleeve to be rotatable about the axis of the sleeve. In the event of development, such magnets will be brought to a position for causing the tip of the developer existing on the sleeve to contact the drum 9, as shown in FIG. 6A. To space apart the tip of the developer from the drum 9, the magnets will be brought to a position for causing the tip of the developer to remain clear of the drum 9, as shown in FIG. 6B. Alternatively, there may be provided a mechanism for moving a doctor blade, which regulates the amount of developer on the sleeve, in such a manner as to change the doctor gap. Then, the doctor blade will prevent the tip of the developer from contacting the drum 9 by regulating the amount of developer being transported toward the position where the sleeve faces the drum 9.

Further, the developing unit may be selectively moved away from the surface of the drum 9. For example, in the construction shown in FIG. 1, a moving mechanism may be associated with each of the developing units.

Figure 7:
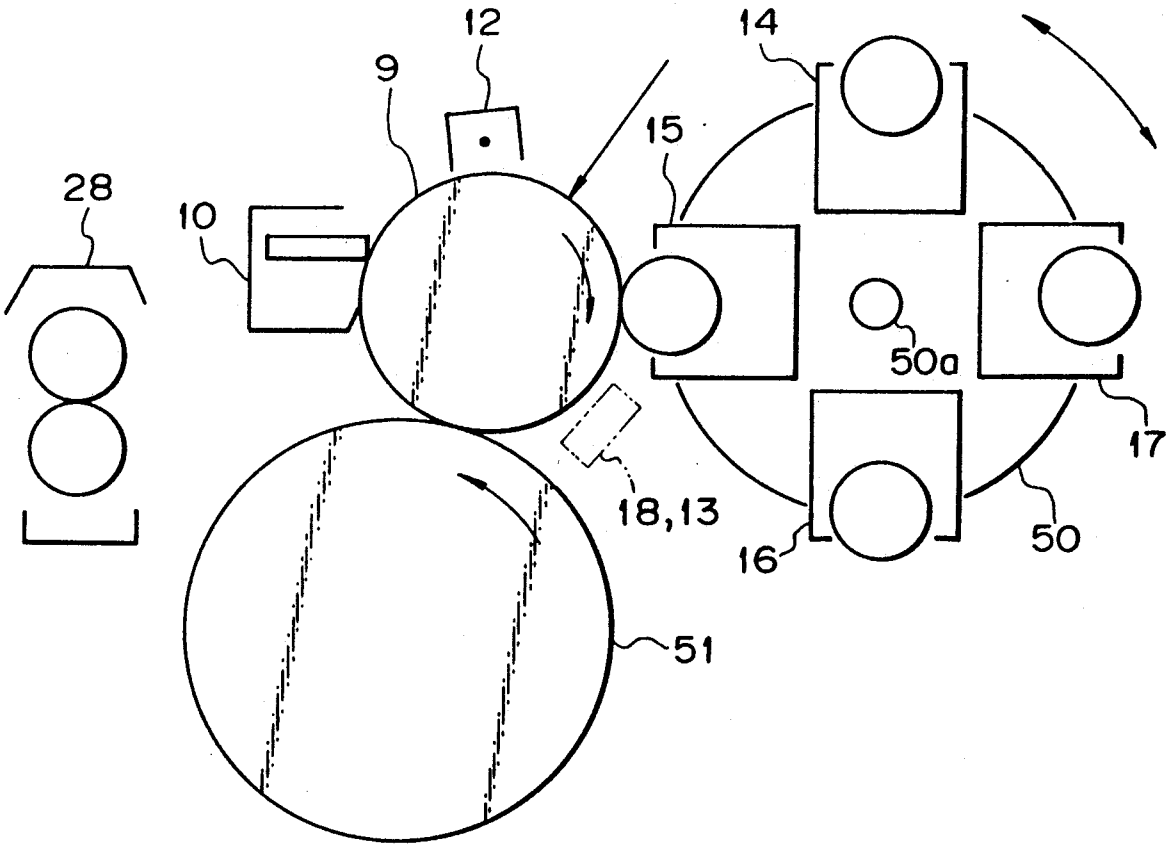
FIG. 7 is a fragmentary section showing an alternative embodiment of the present invention.

FIG. 7 shows an alternative arrangement wherein the developing units 14–17 are affixed to a rotary support mechanism 50 which is rotatable about a shaft 50*a* parallel to the shaft of the drum 9. The support mechanism 50 is rotated such that one of the developing units 14–17 expected to develop a latent image formed on the drum 9 by particular color data is brought to a position where it faces the drum 9. In such a position, the developer at the developing position contacts the drum 9 to develop the latent image. In this type of arrangement, to prevent the developer from contacting the drum 9, the support mechanism 50 may be rotated to a position where none of the developers of the developing units 14–17 contacts the drum 9. The general construction and operation of this arrangement will be described in detail later as an alternative embodiment of the present invention.

The implementations against noise and toner and carrier deposition described above in relation to the potential sensor 13 and optical sensor 18 are also practicable with the toner concentration sensor. Therefore, the arrangements shown in FIGS. 6A, 6B and 7 are also applicable to the toner concentration sensor.

Assume image forming equipment of the type having a sensor located downstream of a developer expected to develop a latent image formed on an image carrier and facing the image carrier, and sensing the potential of or the reflection from a portion of the image carrier which does not positively deposit a toner with the sensor. An alternative embodiment of the present invention sets up a condition wherein a toner is fully prevented from depositing on the above-mentioned portion of the image carrier, as will be described with reference to FIG. 7. Specifically, FIG. 7 shows a color electrophotographic copier representative of the alternative embodiment of the invention. As shown, the main charger 12, cleaning device 10 and so forth are arranged around the drum 9, as in the construction shown in FIG. 1. In this embodiment, the four developing unis 15, 16, 17 and 14 storing the cyan toner, magenta toner, yellow toner and black toner, respectively, are affixed to the rotary support means 50 which is rotatably mounted on the shaft 50*a* parallel to the shaft of the drum 9. This kind of developing device is generally referred to as a revolver and brings one of the developing units 14–17 to a developing region where the developing unit faces the drum 9. A paper sheet will be wrapped around a transfer drum 51 which is located to face the drum 9. The reference numeral 28 designates a fixing device for fixing a toner image transferred from the drum 9 to the paper sheet.

The revolver outlined above is conventional and selectively operable in a color mode for forming a full-color image or in a monocolor mode for forming a monocolor image. In the color mode, after the surface of the drum 9 has been uniformly charged by the main charger 12, optics, not shown, forms a latent image on the drum 9 in response to color data. One of the developing units 14–17 brought to the developing region develops the latent image by a toner corresponding to the latent image. The resulting toner image is transferred from the drum 9 to a paper sheet wrapped around the transfer drum 51, and then the remaining toner on the drum 9 is removed. During this period of time, the revolver 4 is rotated to bring another developing unit corresponding to the next color to the developing region. In this condition, the optics forms a latent image on the charged surface of the drum 9 in response to the next color data. The latent image is developed by the developing unit located at the developing region, and the resulting toner image is transferred to the paper sheet retained on the transfer drum 51 over the previous toner image. Such a procedure is repeated until a full-color toner image has been formed on the paper sheet. The paper sheet with the full-color toner image is separated from the transfer drum 51 by a device, not shown, and then transported to the fixing device 21. After the toner image has been fixed by the fixing device 21, the paper sheet is driven out of the copier.

In the monocolor mode, one of the developing units 14–17 selected by the operator is moved to the developing region to develop a latent image formed on the drum 9. After the resulting toner image has been transferred to a paper sheet on the transfer drum 51, the paper sheet is separated from the drum 51 and then driven toward the fixing device 28.

In the illustrative embodiment, the optical sensor 18 and potential sensor 13 are each located at a position downstream of the developing region and upstream of a transfer region where the transfer drum 51 faces the drum 9, e.g., a position indicated by a dash-and-dots line in FIG. 7. The optical sensor 18 senses the toner concentration of the developer to allow it to be controlled. The potential sensor 13 is used to control the output of the main charger 12 and the bias for development to be applied to each developing unit. The control over the toner supply and the amount of charge is conventional and will not be described specifically. The following description will concentrate on the operations of the sensors 18 and 13.

To begin with, how the optical sensor 18 senses the deposition potential portion where the toner is deposited and the reference potential portion will be described.

The toner concentration of the developer may be sensed at any one of the times heretofore proposed. For example, the toner concentration may be sensed every time a predetermined number of copies are produced or every time a predetermined period of time elapses on a developing unit basis. Alternatively, to prevent the sensing time from noticeably differing from one developing unit to another, the toner concentration may be sensed in all of the developing units every time a predetermined number of copies are produced or every time a predetermined period of time expires with no regard to which of the developing units are used. Should the toner concentration be sensed in the individual developing units, the number of copies produced might differ from one developing unit to another in relation to the frequency of monocolor mode operation. At the time for sensing a toner concentration, the previously mentioned deposition potential portion is formed on the drum 9 and then developed by the developing unit of interest to thereby form a toner deposited portion. The optical sensor 18 senses the amount of toner deposition in the toner deposited portion. On the other hand, the reference potential portion is formed on the drum 9 before or after the deposition potential portion and at such a time that none of the developing units exists in the developing region when it passes the developing region. Specifically, when the toner concentration should be sensed while a full-color mode operation is under way, the reference potential portion is so formed as to pass the developing region when the developing unit to operate is being replaced, i.e., when none of the developers of the developing units contacts the drum 9. When the toner concentration should be sensed during monocolor mode operation, the reference potential portion is so formed as to pass the developing region after the last latent image in the monocolor mode, i.e., the last latent image of continuous copies or the last latent image of a single copy has moved away from the developing region.

As stated above, when the toner concentration is to be sensed during monocolor mode operation and copies are continuously produced in the monocolor mode, the embodiment does not form the reference potential portion between nearby latent images on the drum 9. This is because in the monocolor mode the developer of the developing unit should advantageously be held in contact with the drum 9 throughout the interval between the start of development of the first latent image and the end of development of the last document in order to increase the copying speed. By contrast, in the color mode, the period of time necessary for one developing unit to be replaced with another is effectively used. Stated another way, in a copier of the type operating at a relatively low speed in the monocolor mode, the reference potential portion may be formed between nearby latent images on the drum 9.

In some copier, an area great enough to be sensed by the optical sensor 18 may be not available for the reference potential portion which is expected to pass the developing region when the developers of the developing units are out of contact with the drum 9, depending on the peripheral speed of the drum 9, the period of time necessary for the developing unit to be switched over, and the period of time necessary for the sensor 18 to rise. In such a copier, at least the reference potential portion may be formed and sensed by the sensor 18 while a copying operation is not under way, e.g., when the drum 9 is in rotation either before or after a copying operation, during warm-up or similar preparatory stage after the turn-on of the power source, or during standby stage.

In the illustrative embodiment, the reference potential portion is used to protect the calculated toner concentration from the influence of a change in the quantity of light of the optical sensor 18 due to aging, contamination of the sensor 18, etc. In addition, in the embodiment, none of the developers of the developing units contacts the drum 9 when the reference potential portion passes the developing region. This makes it needless to form a reference potential portion having a relatively low potential on the drum 9 by illuminating the charged surface of the drum by predetermined light, as has been customary. Instead, the reference potential portion may be implemented by the surface of the drum 9 undergone cleaning and discharging but not undergone uniform charging or the surface of the drum 9 simply uniformly charged. In any case, assuming that the drum 9 rotates at a peripheral speed of V mm/sec and the developers do not contact the drum 9 over a period of time of t, a region where the toners do not deposit can be formed over a length of Vt mm. As the optical sensor 18 senses such a region, the influence of the change in the quantity of light of the sensor 18 due to aging and that of the contamination of the sensor 18 by the toners are eliminated on the basis of the output of the sensor 18.

How the potential sensor 13 senses the potential pattern is as follows.

The characteristic of the drum 9, for example, can be sensed by using the potential pattern at any of various times heretofore proposed. In practice, the times for forming and sensing the potential pattern are the same as the times described above in relation to the reference potential portion. Specifically, the potential pattern is formed at such a time that none of the developing units exists in the developing region when it passes the developing region. More specifically, when the toner concentration is to be sensed during full-color mode operation, the potential pattern is so formed as to pass the developing region when the operative developing unit is being replaced with another, i.e., when none of the developers contacts the drum 9. When the toner concentration is to be sensed during monocolor mode operation, the potential pattern is so formed as to pass the developing region after the last latent image, i.e., the last image of continuous copies or the last image of a single copy has passed the developing region. This, however, does not apply to a copier in which an area great enough to be sensed by the potential sensor 13 is not available for the potential pattern which is expected to pass the developing region when the developers of the developing units are out of contact with the drum 9, depending on the peripheral speed of the drum 9, the period of time necessary for the developing unit to be switched over, and the period of time necessary for the sensor 13 to rise. In such a copier, the potential pattern may be formed and sensed by the sensor 13 while a copying operation is not under way, e.g., when the drum 9 is in rotation either before or after a copying operation, during warm-up or similar preparatory stage after the turn-on of the power source, or during standby stage.

The principle of the illustrative embodiment is also applicable the arrangement shown in FIGS. 1–3 in which the developing units 15, 16, 17 and 14 are located at predetermined positions around the drum 9. Specifically, even when the developing units 15, 16, 17 and 14 are fixed in place around the drum 9 and the optical sensor 18 and potential sensor 13 are located downstream of such developing units with respect to the rotation of the drum 9, the portion of the drum 9 which does not positively deposite a toner can be so conditioned as to fully prevent a toner from depositing thereon. This is successful in promoting accurate sensing of the potential of or the reflection from the above-mentioned portion. In this case, the prerequisite is that each developing unit in the fixed position be capable of assuming an operative state in which the developer contacts the drum 9 or an inoperative position in which the former does not contact the latter, as needed. To meet this requisite, at least each developing sleeve may be supported in the copier such that the distance between the sleeve and the drum 9 is variable (e.g. the developing unit is supported in the copier such that the distance between it and the drum 9 is variable). Alternatively or in addition, the amount of developer carried on a developer carrier disposed in the developing unit may be controlled to one which causes the developer to contact the drum 9 or one which does not cause the former to contact the latter.

The amount of developer carried on the developer carrier as mentioned above may be controlled by any one of the configurations shown in FIGS. 4A and 4B, 5A and 5B, and 6A and 6B. Specifically, in FIGS. 4A and 4B, while the reference exposed portion to be sensed by the optical sensor 18 or the potential pattern to be sensed by the potential sensor 13 is to pass the developing region, the developing sleeve, e.g., 16*a* is rotated in the opposite direction to the direction for development in all of the developing units. As a result, the developer is removed from the region of the sleeve 16*a* that faces the drum 9 and prevented from contacting the drum 9. In FIGS. 5A and 5B, when the reference exposed portion or the potential pattern is to pass the developing region, the magnetic shield plate 44 is brought to the position corresponding to the developer scoop region A in all of the developing units. This also prevents the developer carried on the developing sleeve, e.g., 14*a* from contacting the drum 9. Further, in FIGS. 6A and 6B, when the reference exposed portion or the potential pattern is to pass the developing region, the magnets disposed in the developing sleeve of each developing unit are brought to a position where the tip of the developer does not contact the drum 9.

Figure 9A:
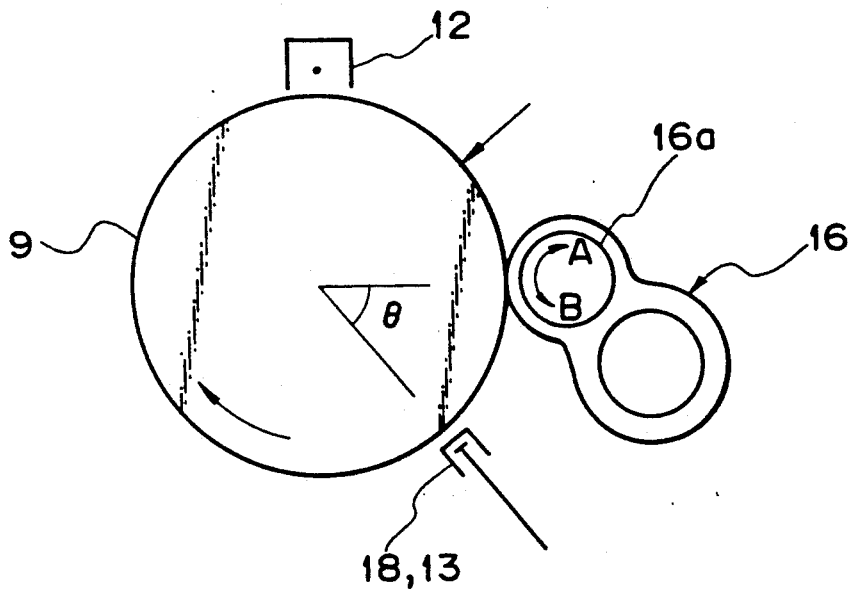
FIG. 9A shows a positional relation of a main charger, sensors and a developing unit arranged around a photoconductive drum in another copier.
Figure 9B:
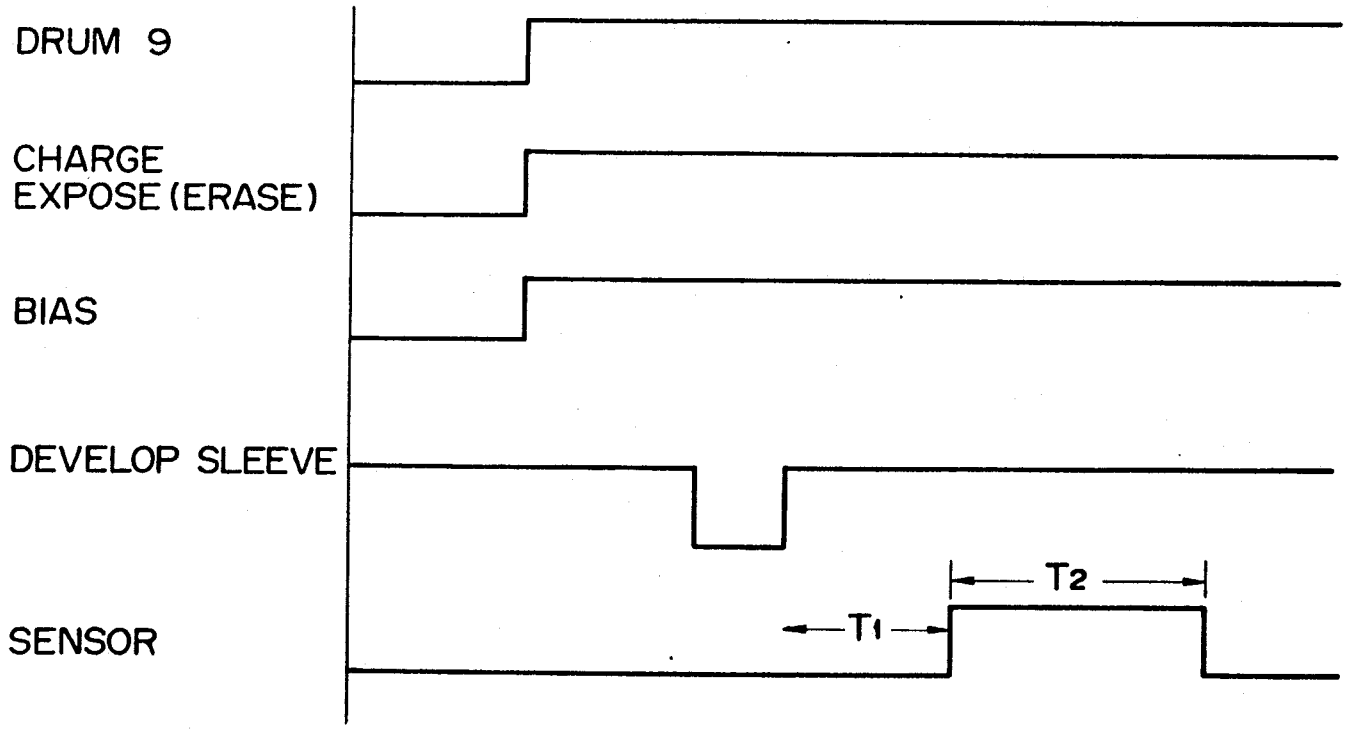
FIG. 9B is a timing chart indicative of a specific procedure in which a sensor senses a potential or similar factor.

FIG. 9B shows a specific procedure in which the potential sensor senses, before the image forming process, the potential of the non-deposition portion formed on the drum 9. FIG. 9B shows the positional relation of the main charger 12, sensors 18 and 13 and developing units (only the M developing unit 16 is shown) for reference. As shown in FIG. 9B, on the start of rotation of the drum 9, the drive of the main charger 12 and eraser and the application of the bias for development to the developing sleeve 16*a* begin. Slightly later than this, the sleeve 16*a* having been in a halt is reversed for a predetermined period of time to remove the developer. As a result, the developer is prevented from connecting the developer in the developing unit 16 to the surface of the drum 9. Part of the drum 9 moved away from the part of the developing unit where the developer is absent is used as the reference exposed portion to be sensed by the optical sensor 18 or the potential pattern to be sensed by the potential sensor 16. Specifically, on the elapse of a period of time $T_1$ necessary for the above-mentioned part of the drum surface to reach the sensor 18 or 13, the sensor 18 or 13 senses a reflection or a surface potential over a predetermined period of time $T_2$. The period of time $T_2$ may be the same as, for example, the period of time necessary for the drum 9 to complete one rotation.

While the embodiments of the present invention have been shown and described in relation to a color electrophotographic copier, they are even practicable with an electrophotographic copier or similar image forming apparatus having a single developing unit.

In summary, it will be seen that the present invention provides image forming equipment which allows a sensor to sense the state of a developer stably without any noise, allows a sensor to sense a process condition stably without any noise while eliminating wasteful developer consumption and preventing the life of an image carrier from being shortened by needless carrier and toner particles, and allows a sensor to sense the potential of or the reflection from a portion of the image carrier which does not positively deposit a toner with accuracy.

Various modifications will become possible for those skilled in the art after receiving the teachings of the present disclosure without departing from the scope thereof.

What is claimed is:

1. Image forming equipment locating an image carrier and a developer carrier face-to-face for forming an AC-superposed DC electric field between said image carrier and said developer carrier and developing an electrostatic latent image formed on said image carrier by said electric field, said equipment comprising:

sensing means adjoining part of a developing device where a developer is stored for sensing a state of said developer; and isolating means for cutting off, before said sensing means senses a state of the developer, electrical connection of a bias application member to which a bias is applied for forming the electric field and the developer stored in said developing device and adjoining said sensing means via the developer existing in said developing device.

2. Image forming equipment locating an image carrier and a developer carrier face-to-face for forming an AC-superposed DC electric field between said image carrier and said developer carrier and developing an electrostatic latent image formed on said image carrier by said electric field, said equipment comprising:

sensing means adjoining part of a developing device where a developer is stored for sensing a state of said developer;

first control means for setting up, before said sensing means senses a state of the developer, a condition wherein said developer in the developing device does not contact said image carrier; and second control means for interrupting, before said sensing means senses a process condition of said image forming equipment, at least an AC bias for forming the electric field.

3. Equipment as claimed in claim 2, wherein said developing device comprises a mechanism for controlling a position of magnets which are disposed in said developer carrier for magnetically attracting the developer containing magnetic particles onto said image carrier to thereby form a brush;

said first control means setting up said condition by moving said magnets to a position which prevents said brush from contacting said image carrier.

4. Image forming equipment locating an image carrier and a developer carrier face-to-face for forming an AC-superposed DC electric field between said image carrier and said developer carrier and developing an electrostatic latent image formed on said image carrier by said electric field, said equipment comprising:

a plurality of developing devices each storing a developer therein and provided with sensing means in close proximity to part thereof where said developer is stored for sensing a state of said developer;

first control means for setting up, before said sensing means senses a condition of said developer, a condition wherein at least the developer of one of said plurality of developing devices whose sensing means is to perform a sensing operation does not contact said image carrier; and second control means for interrupting, before said sensing means senses a state of the developer, at least an AC bias applied to all of said plurality of developing devices for forming the electric field.

5. Equipment as claimed in claim 4, wherein said plurality of developing devices each comprises a mechanism for controlling a position of magnets which are disposed in the developer carrier for magnetically attracting the developer containing magnetic particles onto said image carrier to thereby form a brush;

said first control means setting up said condition by moving said magnets to a position which prevents the brush from contacting said image carrier.

6. Image forming equipment locating an image carrier and a developer carrier face-to-face for generating an AC-superposed DC electric field between said image carrier and said developer carrier and developing an electrostatic latent image formed on said image carrier by said electric field, said equipment comprising:

sensing means located to face a surface of said image carrier for sensing a process condition of said image forming equipment;

first control means for setting up, before said sensing means senses a process condition of said image forming equipment, a condition wherein a developer stored in a developing device does not contact said image carrier; and second control means for interrupting, before said sensing means senses a process condition of said image forming equipment, at least an AC bias for forming the electric field.

7. Equipment as claimed in claim 6, wherein a plurality of developing devices are arranged around said image carrier;

said first control means setting up, before said sensing means senses a process condition of said image forming equipment, a condition wherein the developers stored in all of said plurality of developing devices do not contact said image carrier;

said second control means interrupting, before said sensing means senses a process condition of said image forming equipment, at least an AC bias in all of said plurality of developing devices for forming the electric field.

8. Equipment as claimed in claim 7, wherein said plurality of developing devices each comprises a mechanism for controlling a position of magnets which are disposed in said developer carrier for magnetically attracting the developer containing magnetic particles onto said image carrier to thereby form a brush;

said first control means setting up said condition by moving said magnets to a position which prevents the brush from contacting said image carrier.

9. An image forming equipment wherein a sensor is located at a position downstream of a developing unit for developing an electrostatic latent image formed on a surface of an image carrier with respect to an intended direction of movement of said surface and positioned to face said surface, said sensor sensing a potential of or a reflection from a portion of said surface of said image carrier which does not positively deposit a toner, a non-contact condition wherein a developer stored in said developing unit does not contact said surface of said image carrier is set up while said portion of said surface passes a predetermined developing region, wherein a plurality of developing units each storing a developer of particular color are located to face the surface of said image carrier;

said equipment being selectively operable in a color mode in which said plurality of developing units are sequentially replaced such that one of said developing units assumes an operative position where the developer stored therein contacts the surface of said image carrier, and a monocolor mode using one of said plurality of developing units;

said sensor performing a sensing operation at a predetermined time;

when said sensor is to perform a sensing operation while said color mode is underway, a period of time during which none of the developers of said developing units contacts the surface of said image carrier being provided when the developing unit assuming the operative position is replaced to thereby set up said non-contact condition, said sensor sensing said portion which does not positively deposit a toner by passing said portion through the predetermined developing region;

when said sensor is to perform a sensing operation while said monocolor mode is underway, one of said developing units used in said monocolor mode being brought into said non-contact condition after the last latent image formed in said monocolor mode has moved away from the predetermined developing region, said sensor sensing said portion which does not positively deposit a toner by passing said portion through said predetermined developing region.

* * * * *